US007134480B2

(12) United States Patent
Iversen et al.

(10) Patent No.: US 7,134,480 B2
(45) Date of Patent: Nov. 14, 2006

(54) FILLING-TUBE CONSTRUCTION FOR PROVIDING A CONNECTION BETWEEN A MOULD TO BE FILLED WITH MOLTEN METAL AND A MOULD-FILLING FURNACE

(75) Inventors: Peter Møller Iversen, Brønshøj (DK); Uffe Andersen, Skævinge (DK)

(73) Assignee: Disa Industries A/S (DK)

( * ) Notice: Subject to any disclaimer, the term of this patent is extended or adjusted under 35 U.S.C. 154(b) by 341 days.

(21) Appl. No.: 10/478,371

(22) PCT Filed: May 31, 2001

(86) PCT No.: PCT/DK01/00380

§ 371 (c)(1),
(2), (4) Date: Nov. 21, 2003

(87) PCT Pub. No.: WO02/102531

PCT Pub. Date: Dec. 27, 2002

(65) Prior Publication Data

US 2004/0129401 A1 Jul. 8, 2004

(51) Int. Cl.
*B22D 37/00* (2006.01)

(52) U.S. Cl. ..... 164/337; 164/306

(58) Field of Classification Search ..... 164/133, 164/337, 119, 113, 306, 136
See application file for complete search history.

(56) References Cited

U.S. PATENT DOCUMENTS 3,009,218 A * 11/1961 Rearwin ..... 164/257

(Continued)

FOREIGN PATENT DOCUMENTS

WO WO 99/00202 1/1999

*Primary Examiner*—Kevin Kerns
*Assistant Examiner*—Ing-Hour Lin
(74) *Attorney, Agent, or Firm*—Stites & Harbison PLLC; Marvin Petry

(57) ABSTRACT

In a filling-tube construction (1, 2) for providing a connection between a mould (6) to be filled with molten metal and a mould-filling furnace (3) containing molten metal (5), said mould (6) having at least one casting cavity (7), the lowermost part of each such cavity communicating with a filling duct (8), at least one end of which is open to the outside of said mould (6) and adapted to be temporarily connected to the filling-tube construction (1, 2) to receive molten metal (5) from the mould-filling furnace (3), the mould-filling furnace being adapted to contain molten metal (5) and to transfer said molten metal (5) under a controlled pressure through the filling-tube construction (1, 2) and to the filling duct (8), the filling-tube construction comprises a first section (1) extending from a position close to the bottom of said mould-filling furnace (3) up to an intermediate position closer to the filling duct (8) and at least one separate second section (2) providing a connection from the upper end of the first section (1) to the open end of the filling duct (8) and adapted to provide a fluid-tight connection to the upper end of the first section (1) and the open end of the filling duct (8). In this way an easy adjustment and/or exchange of parts of the filling-tube constructions can be provided by simply adjusting and/or exchanging the second section (2), without disassembly of the connection between the first section (1) and the mould-filling furnace (3). The invention also includes a method of modifying a conventional constructed filling tube to a filling tube as described above.

15 Claims, 1 Drawing Sheet

U.S. PATENT DOCUMENTS 3,430,680 A * 3/1969 Leghorn ..... 164/81
4,576,218 A * 3/1986 Artz et al. ..... 164/431
5,735,334 A * 4/1998 Sutton et al. ..... 164/130
6,341,640 B1 1/2002 Iversen et al.
6,446,700 B1 * 9/2002 Klug ..... 164/126

* cited by examiner

FILLING-TUBE CONSTRUCTION FOR PROVIDING A CONNECTION BETWEEN A MOULD TO BE FILLED WITH MOLTEN METAL AND A MOULD-FILLING FURNACE

CROSS-REFERENCE TO RELATED APPLICATION

This application is a 371 of PCT/DK01/00380 filed on May 31, 2001.

TECHNICAL FIELD

The present invention relates to a filling-tube construction for providing a connection between a mould to be filled with molten metal and a mould filling furnace.

BACKGROUND ART

In filling-tube constructions of this kind it is known to provide a filling tube in one piece extending from a position close to the bottom of the mould-filling furnace to a filling head, which is connectable to the open end of the filling duct. A construction of this kind is e.g. known from WO 99/00202. When using a filling tube of this kind, the adjustment of its position relative to the mould, especially a mould in a mould string, is relatively complex involving the loosening of the fixation of the complete filling tube to the mould-filling furnace, in order to adjust the position and angle of the filling-tube head relative to the mould surface to be connected thereto in a sealing way. Normally the filling-tube construction comprises a bend in order to provide a suitably short construction and a suitable connection to the open end of the filling duct, said bend giving rise to problems, when the filling tube has to be cleaned from contaminants, such as oxidation products. Furthermore, when different types of filling heads are to be used, the whole filling-tube construction will have to be replaced in order to provide a new type of filling head for connecting to a new type of mould.

From EP-A-0 956 916 it is known to solve the cleaning and exchange problems by having the filling tube split up in two or more sections. However, these sections do not provide any adjustment possibilities for the position and angle of the filling-tube head relative to the mould surface.

From EP-A-0 976 476 it is known to provide an angular movability of the filling tube by having the filling tube connected to the filling furnace through a cardan connection. The purpose of this cardan connection is to allow a certain tilting of the mould while connected to the filling tube, and not to provide any form of adjustment. Furthermore, the whole filling-tube construction is moved as one unit without any possibilities of moving one part of the filling tube relative to the other one.

DISCLOSURE OF THE INVENTION

It is the object of the present invention to provide a filling-tube construction of the kind referred to above, with which it is possible to avoid the difficulties explained above, and this object is achieved with a filling-tube construction of said kind, which according to the present invention also comprises a first section extending from a position close to the bottom of said mould-filling furnace up to an intermediate position closer to the filling duct and at least one separate second section providing a connection from the upper end of the first section to the open end of the filling duct, wherein a fluid-tight connection between the first and second section providing a movability of the second section relative to the first section. With this arrangement, the filling-tube construction is split up into two parts, thereby providing an easy possibility of adjusting the position and angle of the second section with disassembly of the connection between the first section and the mould-filling furnace.

Further advantageous embodiments of the filling-tube construction, the effects of which will be evident from the following detailed part of the present description, are set forth in the subordinate claims.

BRIEF DESCRIPTION OF THE DRAWINGS

In the following detailed part of the present description, the invention will be explained in more detail with reference to the exemplary embodiment of a filling-tube construction according to the invention shown in the drawing, in which FIG. 1 schematically shows a filling-tube construction in accordance with the present invention mounted to provide a connection between a mould-filling furnace and a mould.

DESCRIPTION OF THE PREFERRED EMBODIMENTS

Figure 1:
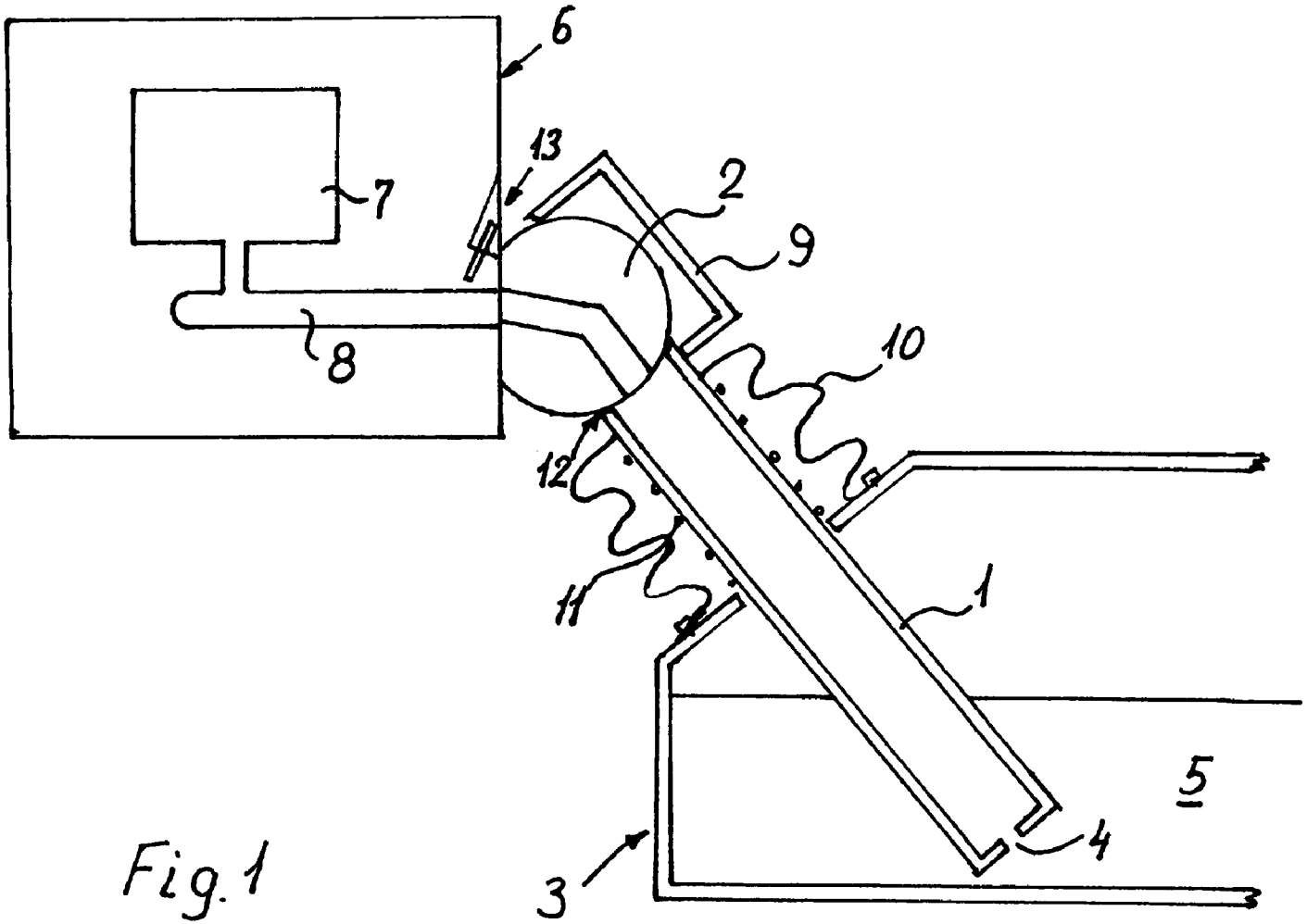

The filling-tube construction schematically shown in FIG. 1 comprises a first section 1 extending from a position close to the bottom of the mould-filling furnace 3 and a second section 2 providing a connection from the upper end of the first section 1 to the open end of the filling-duct 8 in the mould 6. The filling-tube construction 1, 2 provides a connection for filling the casting cavity 7 in the mould 6 with molten metal 5, e.g. aluminium alloys, cast iron, etc. from the mould-filling furnace 3, said filling being provided by setting the mould-filling furnace 3 under pressure, whereby molten metal 5 from the mould-filling furnace 3 will be transferred from the mould-filling furnace 3 to the casting cavity 7 through the restriction 4, the first section 1, the second section 2 and the filling duct 8. The first section 1 is relatively fixedly connected to the mould-filling furnace 3 and the part of the first section 1 extending out of the mould-filling furnace 3 is surrounded by a bellow 10 and a heating wire 11 for keeping the first section at an elevated temperature. The second section 2 is formed as a ball, connected fluid-tight to the upper end of the first section 1, said fluid-tight connection being provided by the formation of a chamfer 12 on the upper end of the first section 1, possibly supplemented by a "fluid gasket", e.g. in the form of thick-flowing boron nitrate.

The second section 2 can thus be adjusted by moving the ball in the chamfer 12 on the upper end of the first section 1 and the second section 2 can be fixed in the adjusted position by means of a fitting 9 pressing the second section 2 against the first section 1. The second section 2 comprises a planar surface for providing the fluid-tight connection to the open end of the filling duct 8 and the above adjustment of the second section 2 is performed in order to provide a secure fluid-tight connection between the second section 2 and the surface of the mould 6. The outlet from the second section 2 forms an angle of approximately 95° with the planar surface, thereby allowing superfluous metal 5 to flow back to the mould-filling furnace 3 after filling of the casting cavity 7. Before this flow back of molten metal 5, the filling duct 8 is closed by a plate 13 moved into the filling duct 8 in a manner not shown, or other means for closing the filling duct 8 are used, e.g. as described in EP 760.723.

Adjustment or exchange of the second section can easily be performed by loosening or dismounting the fitting 9 respectively. The material of the first and second section 1 and 2 will naturally have to be high temperature resistant in accordance with the temperature of the molten metal 5 to be transferred from the mould-filling furnace 3 to the casting cavity 7. High temperature resistant materials for these components are e.g. ceramic materials, graphite materials, refractory cement materials, alutitanate, coated refractory cement, said coating possibly being boron nitrate, ceramic wool coated by a suitable material, e.g. Fiberfax or boron nitrate, or combinations thereof.

The restriction 4 at the bottom of the first section 1 is provided in order to reduce the turbulence in the molten metal flowing back into the mould-filling furnace 3 and reduce the effect of pressure fluctuations due to wave movements in the mould-filling furnace, when the second section 2 is removed from the surface of the mould 6.

Existing filling-tube constructions can be modified into a filling-tube construction in accordance with the present invention by performing the following steps:

a) cutting-off the existing tube at an appropriate position, e.g. immediately below the bend,
b) providing a chamfer 12 at the top of the cut-off tube,
c) fitting a second section 2, e.g. a ball 2, fitting in said chamfer at the upper end of the tube 1,
d) fixing said second section 2 by means of a fitting 9 pressing the second section 2 against the first section 1, and possibly
e) incorporating a restriction 4 at the bottom end of the tube 1.

Above, the present invention has been explained in connection with preferred embodiments relating to a filling-tube construction. However, several modifications will be evident within the scope of the following claims, such modifications comprising formation of the second section 2 with an other configuration for providing the fluid-tight connection to the filling duct 8 and a different connection between the first section 1 and second section 2, etc.

The invention claimed is:

1. A filling-tube construction for providing a connection between a mould to be filled with molten metal and a mould-filling furnace containing molten metal, said mould having at least one casting cavity, the lowermost part of each such cavity communicating with a filling duct, at least one end of which is open to the outside of said mould and adapted to be temporarily connected to the filling-tube construction to receive molten metal from the mould-filling furnace, the mould-filling furnace being adapted to contain molten metal and to transfer said molten metal under a controlled pressure through the filling-tube construction and to the filling duct, said filling-tube construction comprising:

a first section extending from a position close to the bottom of said mould-filling furnace up to an intermediate position closer to the filling duct, said first section being a straight tube without bends; and at least one separate second section providing a connection from the upper end of the first section to the open end of the filling duct and adapted to provide a fluid-tight connection to the upper end of the first section and the open end of the filling duct, wherein a fluid-tight connection between the first and second section providing a movability of the second section relative to the first section.

2. The filling tube in accordance with claim 1, further comprising a restriction at the bottom of the first section.

3. The filling tube in accordance with claim 1, wherein said movability being provided in the form of a ball joint.

4. The filling tube in accordance with claim 3, wherein said ball joint comprising the formation of a chamfer on the upper end of the first section and forming the second section as a ball fitting in said chamfer.

5. The filling tube in accordance with claim 1, wherein the second section comprises a planar surface for providing the fluid-tight connection to the open end of the filling duct.

6. The filling tube in accordance with claim 5, wherein the outlet from the second section forms an angle of approximately 5° with said filling duct.

7. The filling tube in accordance with claim 1, wherein the second section being connected to the first section by means of a fitting pressing the second section against the first section.

8. The filling tube in accordance with claim 7, wherein said fitting is adapted to be loosened in order to enable adjustment of the position of the second section.

9. The filling tube in accordance with claim 1, wherein said first section is formed of a high temperature resistant material.

10. The filling tube of claim 9, wherein said resistant material selected from the group consisting of a ceramic material, a graphite material, cement material or combinations thereof.

11. The filling tube in accordance with claim 1, wherein said fluid-tight connection between said first and second section being secured by use of fluid gasket.

12. The filling tube of claim 11, wherein said fluid gasket comprises a thick-flowing boron nitrate.

13. The filling tube in accordance claim 1, wherein said second section is formed of a material selected from aluminum titanate, coated refractory cement and ceramic wool coated by a suitable material.

14. The filling tube of claim 13, wherein said coated cement is boron nitrate ceramic wool coated by a suitable material.

15. The filling tube of claim 13, wherein said ceramic wool coated by a suitable material is boron nitrate.

* * * * *